United States Patent [19]

Ahrens

[11] 4,379,551

[45] Apr. 12, 1983

[54] PLAYGROUND TUBE SLIDE

[75] Inventor: Paul W. Ahrens, Grinnell, Iowa

[73] Assignee: Miracle Recreation Equipment Company, Grinnell, Iowa

[21] Appl. No.: 183,049

[22] Filed: Sep. 2, 1980

[51] Int. Cl.[3] ..... A63G 21/00

[52] U.S. Cl. ..... 272/56.5 R

[58] Field of Search ..... 272/56.5 R, 56.5 SS; 104/69; 182/48; 285/363, 368, 405

[56] References Cited

U.S. PATENT DOCUMENTS

| | | | |
|---|---|---|---|
| 427,658 | 5/1890 | Bayles | 285/405 |
| 629,590 | 7/1899 | Pardee | 272/56.5 R UX |
| 803,119 | 10/1905 | Logan | 272/56.5 R |
| 971,087 | 9/1910 | Smith | 272/56.5 R UX |
| 1,754,375 | 4/1930 | Sturges | 272/56.5 R UX |
| 1,949,984 | 3/1934 | Walker | 285/363 |
| 2,465,187 | 3/1949 | Barrabee | 272/56.5 R |
| 3,343,793 | 9/1967 | Waser | 104/69 X |
| 3,910,377 | 10/1975 | Zamorski | 182/48 |
| 4,149,710 | 4/1979 | Rouchard | 272/56.5 R |
| 4,192,499 | 3/1980 | Groves, Jr. | 272/56.5 R |
| 4,198,043 | 4/1980 | Timbes et al. | 272/56.5 R |
| 4,299,171 | 11/1981 | Larson | 272/56.5 R X |

FOREIGN PATENT DOCUMENTS

| | | | |
|---|---|---|---|
| 13298 | 11/1896 | Switzerland | 285/368 |

*Primary Examiner*—Richard C. Pinkham
*Assistant Examiner*—Arnold W. Kramer
*Attorney, Agent, or Firm*—Zarley, McKee, Thomte, Voorhees & Sease

[57] ABSTRACT

A tube slide includes a straight metal tube section connected through a radially extending flange to a 90° curved section formed from identical half sections connected together by mating laterally extending flanges being fastened. The curved section is of fiberglass and includes a shingled bed of metal members matingly engaging the top surface of the bottom half section.

7 Claims, 7 Drawing Figures

PLAYGROUND TUBE SLIDE

BACKGROUND OF THE INVENTION

A tube playground slide is desirable as it protects the bed surface from the sun's rays and also makes the children sit down when using it. Sections of the slide have necessarily been straight since it is very difficult and thus not feasible to make them curved. A tube slide is needed that is more interesting than a straight slide and has the flexibility of being designed into various configurations. Furthermore, some physical locations for slides will not permit the length required for a straight slide and thus the curved sections would be desirable to keep the slide traffic within the boundaries of the playground area. A tube slide, to be practical, also must be inexpensive to manufacture, assemble and maintain. It should have a minimum number of component parts and should have considerable flexibility to permit a variety of slide configurations.

SUMMARY OF THE INVENTION

The tube slide of this invention basically includes a combination of metal tube straight sections connected to curved sections through laterally extending annular flanges bolted together. The curved sections are formed from identical half sections fastened together along the length thereof through laterally extending flanges. The connection between sections allows complete rotation of one section relative to the other such that the curved sections may extend in either of opposite directions to form an L slide.

A straight and curved section may be connected to a second straight and curved section to provide an S-shaped slide.

The curved sections are formed from fiberglass and are provided with a metal bed surface formed from shingled metal members matingly engaging the inside surface of the bottom half section. Fastening means extend through the bottom half section and underlie the lower end of the adjacent upper metal member.

The slide does not include any sharp metal edges exposed and the annular mating fastened together radially extending flanges are covered by a pair of L-shaped annular protective members.

DESCRIPTION OF THE PREFERRED EMBODIMENT

Figures 1, 2, 3, 4, 5, 6, 7:
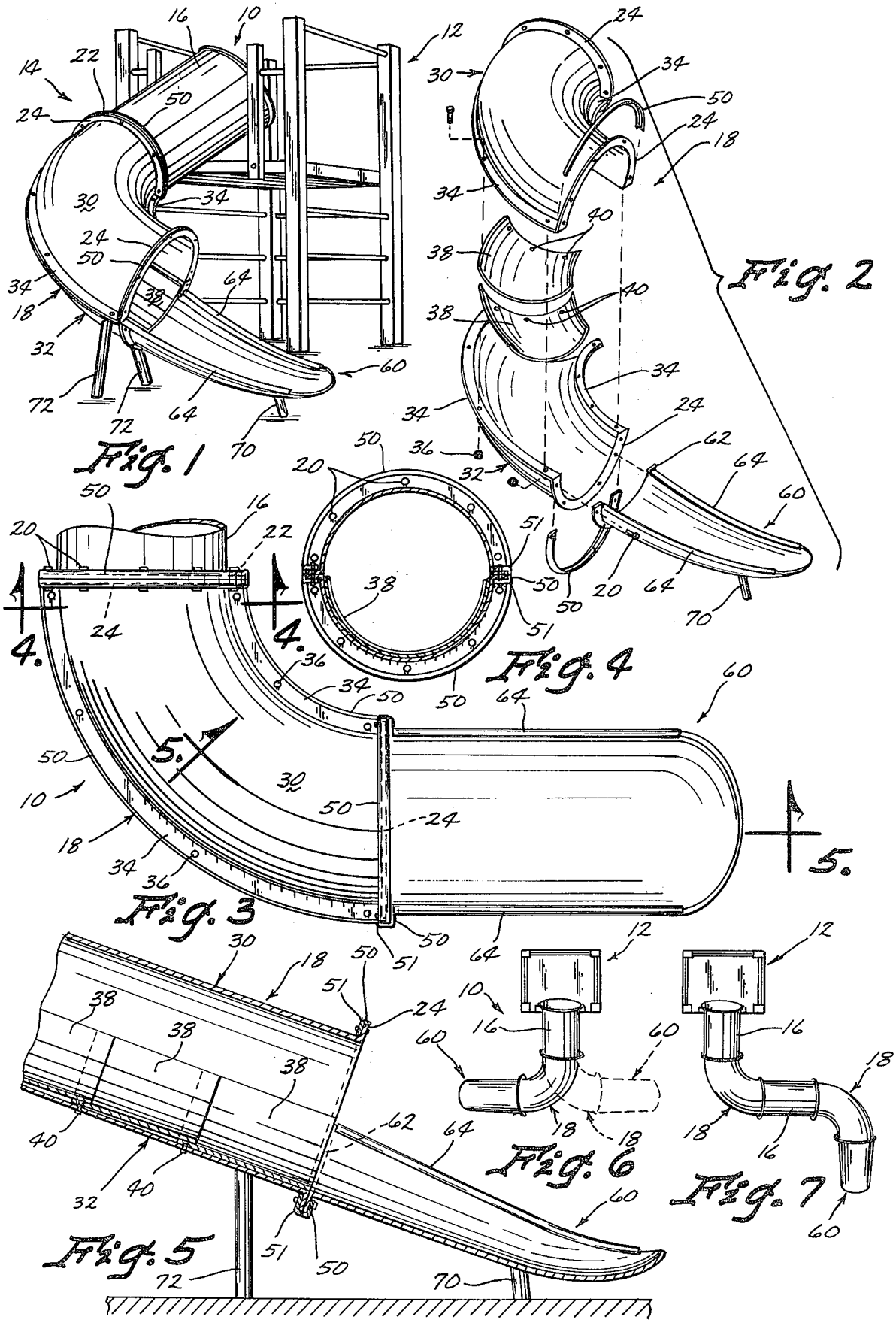
FIG. 1 is a perspective view of an L-shaped slide of this invention.
FIG. 2 is an exploded perspective view of the curved section.
FIG. 3 is a fragmentary top plan view thereof.
FIG. 4 is a cross-sectional view taken along line 4—4 in FIG. 3.
FIG. 5 is a cross-sectional view taken along line 5—5 in FIG. 3.
FIG. 6 is a reduced in scale top plan view showing the L-shaped slide extending in eitheer of opposite directions.
FIG. 7 is a view similar to FIG. 6 but showing an S-shaped slide configuration

The playground tube slide of this invention is referred to generally in FIG. 1 by the reference numeral 10 and includes a deck structure 12 which provides access to the upper end of the slide unit 14.

The slide unit 14 includes basically a combination of straight metal tube sections 16 and curved fiberglass tube sections 18 interconnected by bolts 20 extending through mating radially extending annular flanges 22 and 24 on the straight and curved sections, respectively.

The curved section 18 is formed from identical half sections 30 and 32 arranged as upper and bottom sections respectively. Longitudinally extending lateral side flanges 34 are matingly engaged and secured together by fasteners 36.

A smooth bed surface is provided by shingled metal members 38 matingly engaging the inside surface of the bottom half section 32. Bolt or other fastening means 40 extend through the upper ends of the metal member 38 and underlie the lower ends of the adjacent overlying metal member so as to avoid any sharp surfaces. It is not readily possible to fabricate one single length of curved metal material unless the shorter shingled bed members 38 are an acceptable alternative.

The metal radially extending annular flanges 22 and 24 each include an annular aluminum L-shaped in cross section protective cover 50 which meet along abutting edges as seen in FIG. 3. This eliminates any sharp edges that might otherwise injure the user of the slide. The bolts 20 connect the covers to the flanges 22 and 24. As can be seen in FIG. 4, rounded corners 51 are provided which are safe for contact with the user.

FIGS. 6 and 7 illustrate several possible design configurations with FIG. 6 showing an L-shaped slide extending in opposite directions, as indicated by the solid and dash lines. FIG. 7 comprises basically four sections, two straight and two curved to provide an S-shaped slide. It is seen that through the use of the mating end flanges 22 and 24 on the straight metal tube 16 and the curved tube section 18, respectively, it is possible to turn one tube relative to the other to any desired position.

The lowermost tube section will include an end apron 60 U-shaped in cross section with a radially annular flange 62 for connection to the flange 24, as seen in FIG. 2. A protective tube 64 extends along the side edges. Further, appropriate support posts 70 and 72 are provided along the length of the slide 10.

I claim:

1. A playground tube slide comprising, an elevated deck, a bed extending from said deck to the ground, said bed including a curved tube section having top and bottom half sections interconnected by fastening means engaging laterally outwardly extending flanges along the length of said top and bottom half sections of said curved tube section, said bed including at least one other section which includes a laterally extending arcuate end flange connected to an adjacent laterally extending arcuate end flange on said curved tube section, said curved tube section extending in one direction and being adapted to be turned in the opposite direction by rotating said curved tube section relative to said other section, said half sections of said curved tube section being identical and each including said arcuate end flange at each end, and the bottom section of said curved tube section including a series of shingled metal bed members overlaying the inside surface of said bottom section.

2. The structure of claim 1 wherein said metal bed members are semicircular in cross section for matingly engaging the inside surface of said bottom half section.

3. The structure of claim 2 wherein said metal bed members include fastening means at the upper end extending through said bottom curved half section and said fastening means being disposed under the lower end of the next higher metal bed member.

4. The structure of claim 1 wherein said half sections of said curved tube section are of plastic material.

5. The structure of claim 4 wherein said one other section is tubular in shape and is of metal.

6. The structure of claim 5 wherein a second metal tube section having laterally extending opposite end flanges is connected to said curved tube section at its other end with a second curved tube section connected to the lower end of said second metal tube section so that the overall tube sections are arranged in an S-shape.

7. The structure of claim 1 wherein an annular L-shaped in cross section cover is connected to each annular flange of the interconnected sections with one leg in mating engagement with the adjacent flange and the other leg being positioned in end-to-end opposed relationship with the other leg of the adjacent cover.

* * * * *